US009663311B2

(12) United States Patent
Tanio

(10) Patent No.: US 9,663,311 B2
(45) Date of Patent: May 30, 2017

(54) SHEET FEED DEVICE, AND IMAGE FORMING APPARATUS INCLUDING THE SAME

(71) Applicant: KYOCERA Document Solutions Inc., Osaka-shi, Osaka (JP)

(72) Inventor: Koji Tanio, Osaka (JP)

(73) Assignee: KYOCERA Document Solutions Inc., Osaka-shi, Osaka (JP)

( * ) Notice: Subject to any disclaimer, the term of this patent is extended or adjusted under 35 U.S.C. 154(b) by 0 days.

(21) Appl. No.: 14/939,988

(22) Filed: Nov. 12, 2015

(65) Prior Publication Data

US 2016/0152428 A1 Jun. 2, 2016

(30) Foreign Application Priority Data

Nov. 27, 2014 (JP) ..... 2014-239819

(51) Int. Cl.
*B65H 1/22* (2006.01)
*B65H 1/26* (2006.01)
(Continued)

(52) U.S. Cl.
CPC ..... *B65H 1/266* (2013.01); *B65H 3/5215* (2013.01); *G03G 15/6511* (2013.01);
(Continued)

(58) Field of Classification Search
CPC . B65H 1/26; B65H 1/266; B65H 3/46; B65H 3/52; B65H 3/5207; B65H 3/5215; B65H 3/5246; B65H 3/5253; B65H 3/5261; B65H 3/66; B65H 5/068; B65H 5/36; B65H 2402/31; B65H 2402/64;
(Continued)

(56) References Cited

U.S. PATENT DOCUMENTS 7,862,034 B2 * 1/2011 Kobayashi ..... B65H 1/26 271/145
8,608,154 B2 * 12/2013 Yamada ..... G03G 15/6502 271/164
(Continued)

FOREIGN PATENT DOCUMENTS

| | | | |
|---|---|---|---|
| JP | H03211125 | A | 9/1991 |
| JP | H09216738 | A | 8/1997 |
| JP | 2003149890 | A | 5/2003 |
| JP | 2007197102 | A | 8/2007 |
| JP | 2014169189 | A | 9/2014 |
| JP | 2014181106 | A | 9/2014 |

*Primary Examiner* — Prasad Gokhale

(74) *Attorney, Agent, or Firm* — Alleman Hall Creasman & Tuttle LLP

(57) ABSTRACT

A sheet feed device includes a device main body, a sheet feed cassette, a sheet conveyance path, a sheet feed roller, a retard roller, a support unit, and a pair of lock mechanisms. The retard roller is disposed to face the sheet feed roller in the device main body and, together with the sheet feed roller, forms a sheet feed nip portion through which the sheet is passed. The support unit is disposed in the device main body and supports the retard roller. The lock mechanisms are supported by the support unit in the device main body so as to face the wall portion of the sheet feed cassette. The lock mechanisms are disposed on both sides of the retard roller in the sheet width direction and lock the sheet feed cassette attached to the device main body and position the sheet feed cassette in the attachment direction.

6 Claims, 5 Drawing Sheets

(51) Int. Cl.
*G03G 15/00* (2006.01)
*G03G 21/16* (2006.01)
*B65H 3/52* (2006.01)

(52) U.S. Cl.
CPC ..... *G03G 21/1695* (2013.01); *B65H 2402/64* (2013.01); *B65H 2405/113* (2013.01)

(58) Field of Classification Search
CPC ..... B65H 2404/152; B65H 2404/1521; B65H 2404/54; B65H 2404/7414; B65H 2405/113; B65H 2405/121; B65H 2405/31
See application file for complete search history.

(56) References Cited

U.S. PATENT DOCUMENTS

| | | | | |
|---|---|---|---|---|
| 8,695,965 | B2 * | 4/2014 | Shin | B65H 1/266 271/121 |
| 2004/0041334 | A1 * | 3/2004 | Yoshihara | B65H 1/04 271/145 |
| 2007/0170641 | A1 | 7/2007 | Asada et al. | |
| 2012/0126475 | A1 * | 5/2012 | Shin | B65H 1/266 271/117 |
| 2013/0009359 | A1 * | 1/2013 | Yamada | G03G 15/6502 271/264 |
| 2014/0284872 | A1 | 9/2014 | Murashima et al. | |
| 2015/0298932 | A1 * | 10/2015 | Mizuno | B65H 7/20 271/3.19 |

* cited by examiner

SHEET FEED DEVICE, AND IMAGE FORMING APPARATUS INCLUDING THE SAME

INCORPORATION BY REFERENCE

This application is based upon and claims the benefit of priority from the corresponding Japanese Patent Application No. 2014-239819 filed on Nov. 27, 2014, the entire contents of which are incorporated herein by reference

BACKGROUND

The present disclosure relates to a sheet feed device for feeding sheets one by one, and an image forming apparatus including the sheet feed device.

Conventionally, there has been known, as a sheet feed device for feeding sheets one by one, a sheet feed device attached to an image forming apparatus. The sheet feed device is composed of a pick-up roller, a sheet feed roller, and a retard roller that are provided in an apparatus main body of the image forming apparatus, as well as a sheet feed cassette that is attachable to and detachable from the apparatus main body. The sheet feed cassette stores the sheets. When the pick-up roller is rotated, a sheet is picked up from the sheet feed cassette and is fed in a sheet conveyance direction.

The sheet fed by the pick-up roller enters a sheet feed nip portion that is formed between the sheet feed roller and the retard roller. The sheet is further conveyed toward the downstream in the sheet conveyance direction, by the rotation of the sheet feed roller.

Conventionally, the sheet feed cassette is attached to the apparatus main body by being inserted into the apparatus main body in a predetermined attachment direction. After the sheet feed cassette is attached to the apparatus main body, it is locked by a lock mechanism provided in the apparatus main body. This prevents the sheet feed cassette from being pulled out by mistake while a sheet is being fed.

SUMMARY

A sheet feed device according to an aspect of the present disclosure includes a device main body, a sheet feed cassette, a sheet conveyance path, a sheet feed roller, a retard roller, a support unit, and a pair of lock mechanisms. The sheet feed cassette is inserted and attached to the device main body in a predetermined attachment direction and includes a sheet storage portion and a wall portion, the sheet storage portion storing a sheet, the wall portion standing upright at a position more on a front side in the attachment direction than the sheet storage portion. The sheet conveyance path is provided in the device main body and configured to guide the sheet stored in the sheet storage portion into the device main body from an entrance formed more on the front side in the attachment direction than the wall portion. The sheet feed roller is disposed at a central portion of the device main body in a sheet width direction crossing the attachment direction, on a side of the entrance of the sheet conveyance path and configured to feed the sheet into the sheet conveyance path. The retard roller is disposed to face the sheet feed roller in the device main body and, together with the sheet feed roller, forms a sheet feed nip portion through which the sheet is passed. The support unit is disposed in the device main body and supports the retard roller. The pair of lock mechanisms are supported by the support unit so as to face the wall portion of the sheet feed cassette, wherein the lock mechanisms are respectively disposed on both sides of the retard roller in the sheet width direction and are configured to lock the sheet feed cassette attached to the device main body and position the sheet feed cassette in the attachment direction.

An image forming apparatus according to another aspect of the present disclosure includes the above-described sheet feed device and an image forming portion configured to form an image on the sheet conveyed by the sheet feed roller.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Figure 1:
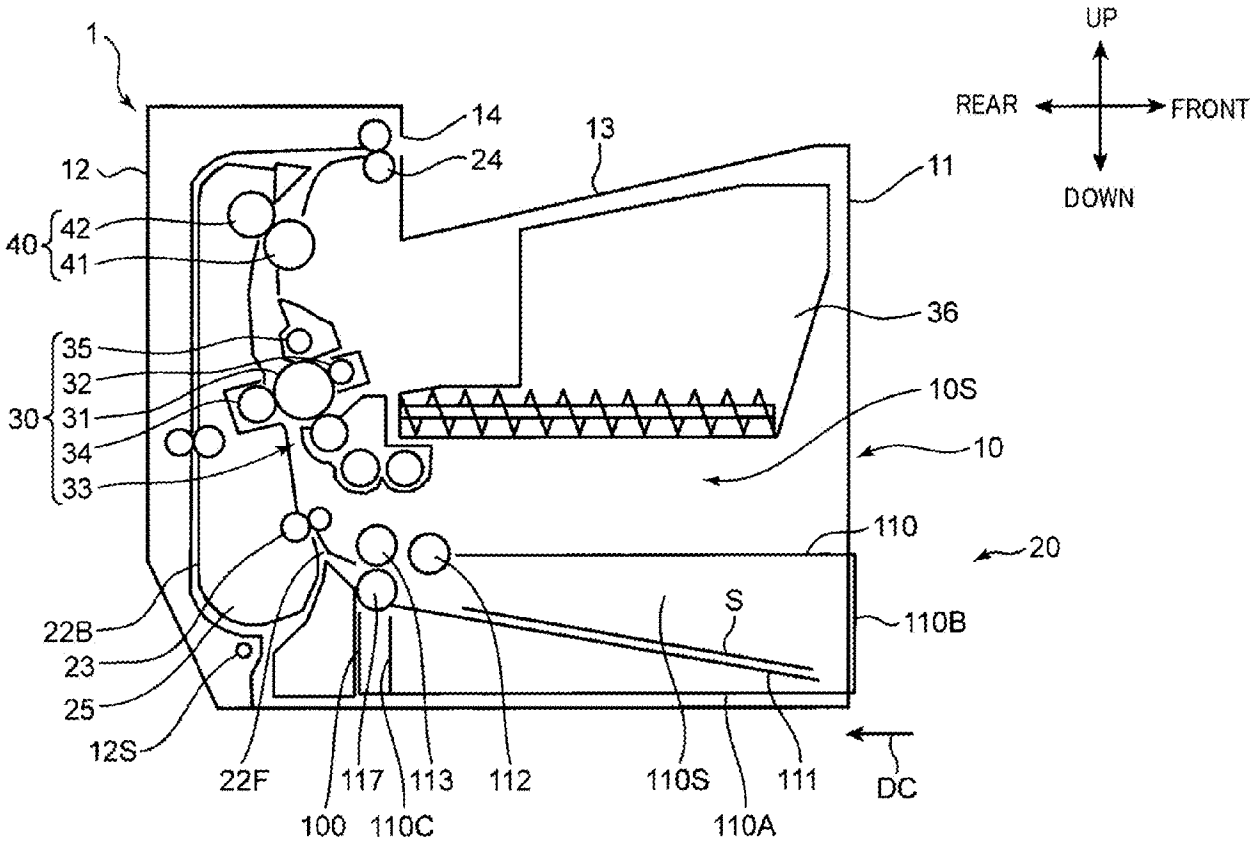
FIG. 1 is a cross section schematically showing the internal configuration of an image forming apparatus including a sheet feed device according to an embodiment of the present disclosure.

The following describes an embodiment of the present disclosure in detail with reference to the attached drawings. FIG. 1 is a side cross section diagram showing the internal configuration of an image forming apparatus 1 according to an embodiment of the present disclosure. In the present embodiment, the image forming apparatus 1 is a monochrome printer as one example. The image forming apparatus 1, however, may be a copier, a facsimile apparatus, or a multifunction peripheral having functions of these, or a color image forming apparatus for forming a color image.

The image forming apparatus 1 includes a main-body housing 10 (the device main body) that has a housing configuration in an approximately rectangular parallelepiped shape. The image forming apparatus 1 also includes a sheet feed portion 20 (the sheet feed device), an image forming portion 30, a fixing portion 40, and a toner container 36 that are stored in the main-body housing 10.

A front cover 11 and a rear cover 12 are provided on the front side and the rear side of the main-body housing 10, respectively. In addition, a sheet discharge portion 13 is provided on the upper surface of the display portion 10, wherein a sheet S after the image formation is discharged onto the sheet discharge portion 13. Various devices used to realize the image formation are stored in an inner space 10S that is defined by the front cover 11, the rear cover 12, and the sheet discharge portion 13.

The image forming portion 30 performs an image formation process of forming a toner image on a sheet S fed from the sheet feed portion 20 (a sheet feed roller 113 described below). The image forming portion 30 includes a photoconductor drum 31. The image forming portion 30 also includes a charging device 32, an exposure device (not shown in FIG. 2), a developing device 33, a transfer roller 34, and a cleaning device 35 that are disposed around the photoconductor drum 31.

An electrostatic latent image is formed on the photoconductor drum 31, and a toner image of the electrostatic latent image is carried on the cylindrical surface of the photoconductor drum 31. The charging device 32 charges the surface of the photoconductor drum 31 uniformly. The cleaning device 35 cleans the toner that has adhered to the circumferential surface of the photoconductor drum 31 after the transfer of the toner image, and conveys the cleaned toner to a collection device (not shown).

The exposure device includes optical-system equipment such as a laser light source, a mirror, and a lens, and forms the electrostatic latent image on the circumferential surface of the photoconductor drum 31 by irradiating, onto the circumferential surface, light that is modified based on the image data which is provided from an external apparatus such as a personal computer. The developing device 33 supplies toner to the circumferential surface of the photoconductor drum 31 so as to form a toner image by developing the electrostatic latent image on the photoconductor drum 31. The transfer roller 34 transfers the toner image formed on the circumferential surface of the photoconductor drum 31, onto the sheet S.

The fixing portion 40 performs a fixing process for fixing the toner image which has been transferred to the sheet, onto the sheet. The fixing portion 40 includes a fixing roller 41 and a pressure roller 42, wherein the fixing roller 41 has a heat source inside, and the pressure roller 42 is pressed against the fixing roller 41 such that a fixing nip portion is formed between the fixing roller 41 and the pressure roller 42. When the sheet S to which the toner image has been transferred is passed through the fixing nip portion, the toner image is fixed onto the sheet S by the heat given from the fixing roller 41 and the pressure given from the pressure roller 42. The toner container 36 accumulates replenishing toner which is to be replenished to the developing device 33.

The sheet feed portion 20 includes a sheet feed cassette 110 that stores sheets S on which the image formation process is to be performed. The sheets S are conveyed one by one into a main conveyance path 22F (the sheet conveyance path) which extends from the sheet feed cassette 110 to the inside of the main-body housing 10.

The main conveyance path 22F and a reversed conveyance path 22B are provided in the main-body housing 10 to convey the sheet S. The main conveyance path 22F extends from a sheet storage portion 110S of the sheet feed portion 20 to a discharge port 14 by passing through the image forming portion 30 and the fixing portion 40, wherein the discharge port 14 is disposed to face the sheet discharge portion 13 that is on the upper surface of the main-body housing 10. The main conveyance path 22F guides the sheet S into the main-body housing 10 from an entrance formed more on the front side in the attachment direction (the direction indicated by the arrow DC in FIG. 5) than the cassette rear wall 110C that is described below. The sheet S is guided from the sheet storage portion 110S to the discharge port 14 by passing through the main conveyance path 22F.

In addition, a registration roller pair 23 is disposed more on the upstream side in the main conveyance path 22F than the transfer nip portion. The sheet S is stopped at the registration roller pair 23, and after a skew correction is made, sent to the transfer nip portion at a predetermined timing for the image transfer. A plurality of conveyance rollers for conveying the sheet S are disposed at appropriate positions in the main conveyance path 22F and the reversed conveyance path 22B. For example, a discharge roller pair 24 is disposed near the discharge port 14.

The reversed conveyance path 22B is a conveyance path used in the double-side printing to return the sheet S, after the sing-side printing, to a position on the upstream side of the image forming portion 30 in the main conveyance path 22F. The reversed conveyance path 22B is formed at a position between an outer side surface of a reversing unit 25 and an inner surface of the rear cover 12 of the main-body housing 10. The rear cover 12 and the reversing unit 25 are respectively pivotable around the axis of a cover fulcrum portion 12S which is provided at the lower ends of the rear cover 12 and the reversing unit 25.

<Sheet Feed Portion>

Figure 2:
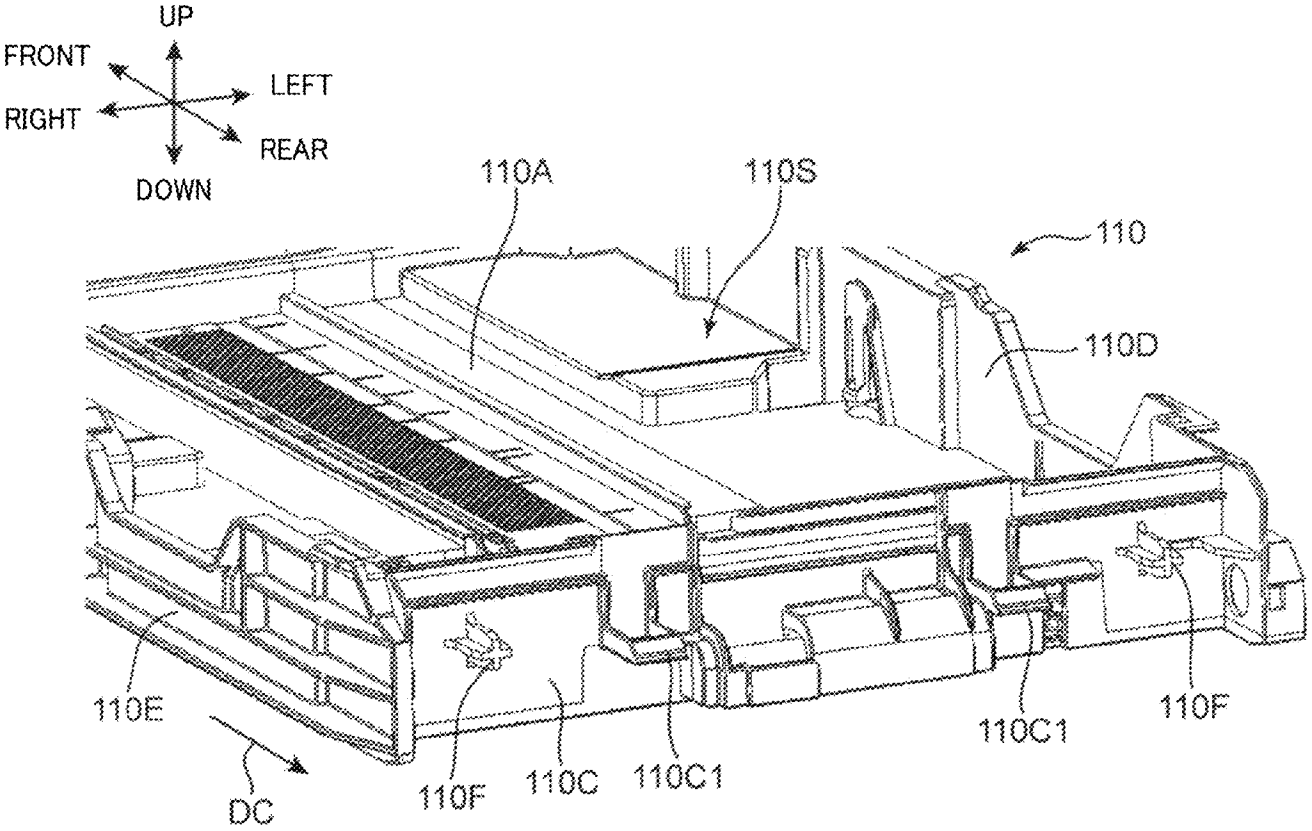
FIG. 2 is a perspective view of a sheet feed cassette according to an embodiment of the present disclosure.
Figure 3:
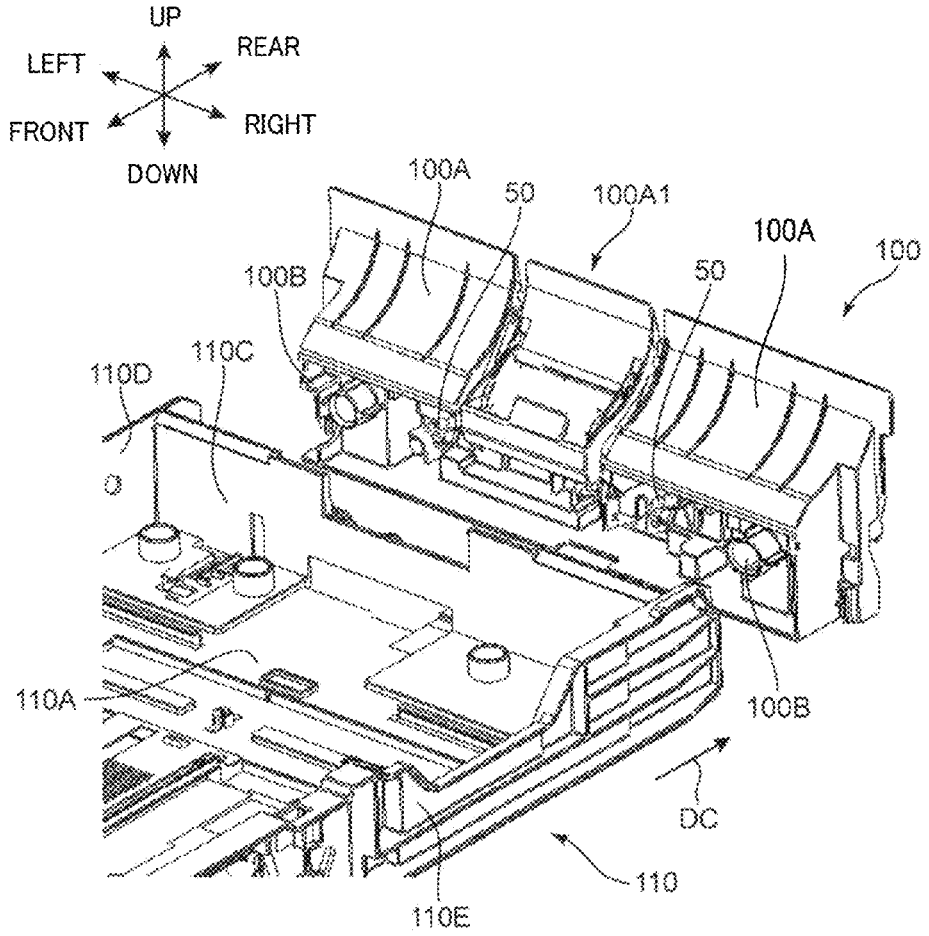
FIG. 3 is a perspective view of the sheet feed cassette and a part of a device main body of the sheet feed device according to an embodiment of the present disclosure.
Figure 4:
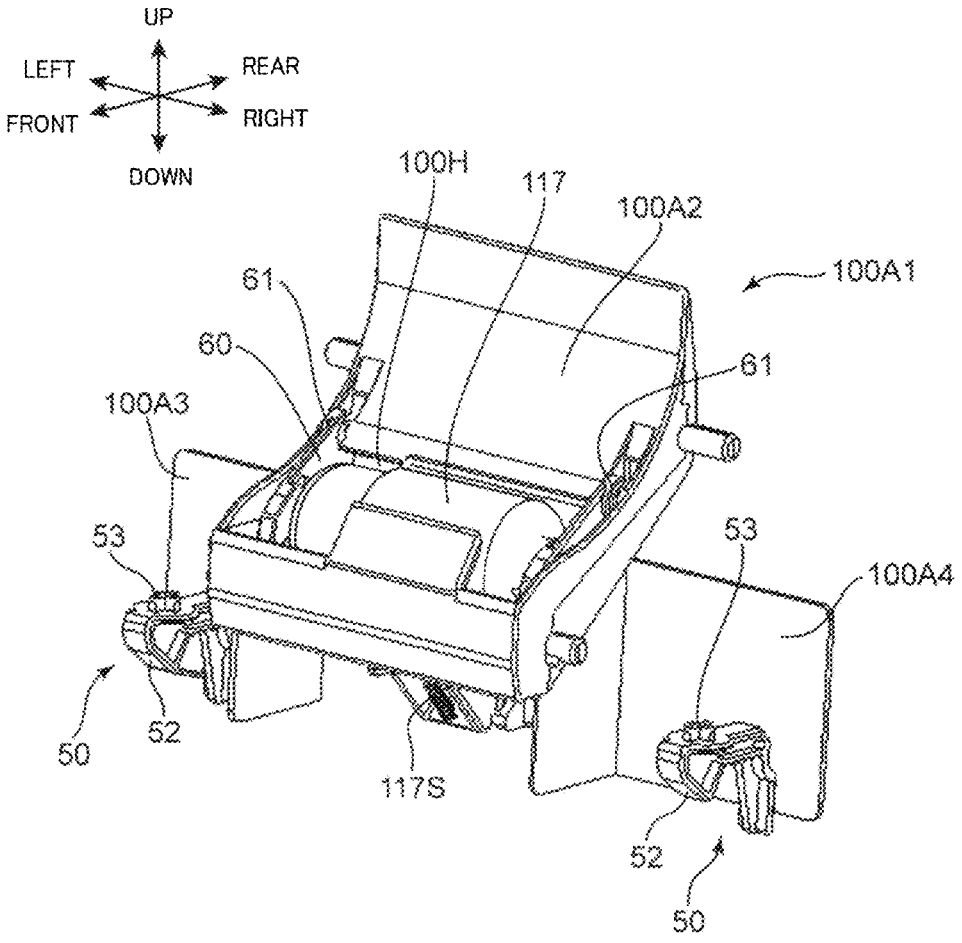
FIG. 4 is a perspective view of a support unit of the sheet feed device according to an embodiment of the present disclosure.
Figure 5:
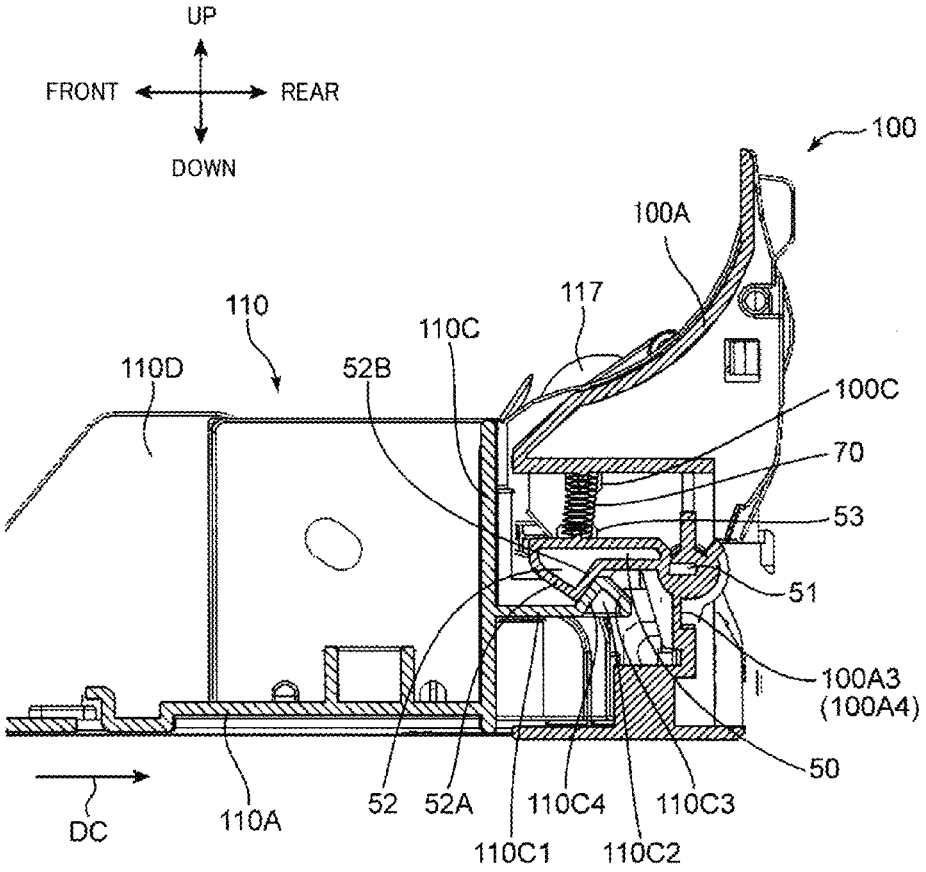
FIG. 5 is a cross section showing a state where the sheet feed cassette according to an embodiment of the present disclosure is attached to the device main body.

Next, the sheet feed portion 20 (the sheet feed device) of the present embodiment is described with reference to FIG. 2 to FIG. 5, as well as FIG. 1. FIG. 2 is a perspective view of the sheet feed cassette 110 according to the present embodiment. FIG. 3 is a perspective view of the sheet feed cassette 110 and a guide wall portion 100 of the sheet feed portion 20 that is described below. FIG. 4 is a perspective view of a central housing 100A1 of the sheet feed portion 20 according to the present embodiment that is described below. FIG. 5 is a cross-sectional view of a state where the sheet feed cassette 110 is attached to the guide wall portion 100 of the main-body housing 10.

The sheet feed portion 20 conveys the sheet S from the sheet feed cassette 110 to the image forming portion 30. The sheet feed portion 20 includes a pick-up roller 112, a sheet feed roller 113, a retard roller 117, and a guide wall portion 100 (the guide unit), as well as the sheet feed cassette 110.

The sheet feed cassette 110 is attachable to and detachable from the main-body housing 10. In the present embodiment, the sheet feed cassette 110 is attached to the main-body housing 10 in the direction (the predetermined attachment direction) indicated by the arrow DC in FIG. 1 through FIG. 3 and FIG. 5. The sheet feed cassette 110 includes a cassette bottom wall 110A and a sheet storage portion 110S. The sheets S are stored in the sheet storage portion 110S. In addition, the sheets S stored in the sheet storage portion 110S are conveyed one by one in the main conveyance path 22F. In an entrance-side part of the main conveyance path 22F, the sheet S is conveyed in the sheet conveyance direction which is along the attachment direction of the sheet feed cassette 110. The sheet feed cassette 110 is in the shape of a box including side walls standing upright from the front, rear, left, and right of the cassette bottom wall 110A. In other words, the sheet feed cassette 110 further includes a cassette front wall 110B, a cassette rear wall 110C (the wall portion), a cassette left wall 110D, and a cassette right wall 110E.

The cassette front wall 110B defines the front side of the sheet feed cassette 110 and is disposed to be flush with the front cover 11 of the main-body housing 10. The cassette rear wall 110C defines the rear side of the sheet feed cassette 110. In other words, the cassette rear wall 110C is a wall portion that stands upright on the front side in a predetermined attachment direction in which the sheet feed cassette 110 is inserted and attached to the main-body housing 10. In addition, the cassette left wall 110D is a side wall that is disposed on the left side of the sheet feed cassette 110 along the attachment direction in such a way as to cross the cassette rear wall 110C. The cassette right wall 110E is a side wall that is disposed on the right side of the sheet feed cassette 110 in parallel to the cassette left wall 110D.

The sheet feed cassette 110 further includes a lift plate 111. The lift plate 111 is disposed on the bottom side of the sheet storage portion 110S of the sheet feed cassette 110. The sheets S are stacked on the upper surface of the lift plate 111. The rear end side of the lift plate 111 is moved upward such that end portions on the downstream side in the sheet conveyance direction, of the sheets S stored in the sheet storage portion 110S are moved toward the pick-up roller 112. More specifically, the lift plate 111 is configured to change its position between a first position and a second position, wherein the first position is along the cassette bottom wall 110A of the sheet feed cassette 110, and the second position is higher than the first position and at which an end portion of the uppermost sheet S among the sheets S stored in the sheet storage portion 110S abuts on the pick-up roller 112, the end portion being on the downstream side in the sheet conveyance direction. The lift plate 111 is moved up and down by a lift portion (not shown) after the sheet feed cassette 110 is attached to the main-body housing 10.

As shown in FIG. 2, the sheet feed cassette 110 further includes a pair of projection portions 110C1 and a pair of positioning pins 110F. The projection portions 110C1 are plate-like members that project from the cassette rear wall 110C in the attachment direction of the sheet feed cassette 110. The pair of projection portions 110C1 are disposed at a central portion of the cassette rear wall 110C with a distance therebetween in the sheet width direction. As shown in FIG. 5, the projection portions 110C1 respectively include projection abutting portions 110C2 on the front side in the attachment direction. The projection abutting portions 110C2 have an approximately triangular shape in a cross section (see FIG. 5) taken along a plane that crosses the sheet width direction. Specifically, the projection abutting portions 110C2 respectively include first abutting surfaces 110C3 and first engaging surfaces 110C4. The first abutting surfaces 110C3 are each, among a pair of inclined surfaces forming a mountain shape of the projection abutting portion 110C2, an inclined surface disposed on the front side in the attachment direction. As shown in FIG. 5, the first abutting surfaces 110C3 are inclined downward toward the front along the attachment direction. On the other hand, the first engaging surfaces 110C4 are inclined surfaces of the projection abutting portions 110C2 and are connected with the rear ends of the first abutting surfaces 110C3. The first engaging surfaces 110C4 are inclined upward toward the front along the attachment direction.

The positioning pins 110F are a pair of pins projecting in the attachment direction from the cassette rear wall 110C and are disposed in such a way as to sandwich the pair of projection portions 110C1 in the sheet width direction. In the present embodiment, as shown in FIG. 2, the positioning pins 110F are each a cross-shaped projection. It is noted that in another embodiment, the positioning pins 110F may be cylindrical pins. The positioning pins 110F are fitted in positioning portions 100B described below, which are boss holes, and restrict the position of the sheet feed cassette 110 in the up-down and left-right directions when the sheet feed cassette 110 is attached to the main-body housing 10.

The pick-up roller 112 (see FIG. 1) is disposed on the entrance side of the main conveyance path 22F to face the sheet storage portion 110S. The pick-up roller 112 is disposed above the rear end portion of the sheet storage portion 110S (end portion on the downstream side in the sheet conveyance direction). The pick-up roller 112 is disposed at a central portion of the main-body housing 10 in the sheet width direction (left-right direction) that crosses the attachment direction of the sheet feed cassette 110. As described above, when the lift plate 111 is raised, the end portion of the sheet S abuts on the pick-up roller 112, the end portion being on the downstream side in the sheet conveyance direction. When, in this state, the pick-up roller 112 is rotated by a driving mechanism (not shown), the pick-up roller 112 feeds the sheet S toward the downstream in the sheet conveyance direction.

The sheet feed roller 113 is disposed on the entrance side of the main conveyance path 22F, more on the downstream side in the sheet conveyance direction than the pick-up roller 112. As is the case with the pick-up roller 112, the sheet feed roller 113 is disposed at a central portion of the main-body housing 10 in the sheet width direction. When driven to rotate by a driving mechanism (not shown), the sheet feed roller 113 conveys the sheet S fed by the pick-up roller 112, further toward the downstream in the sheet conveyance direction.

The retard roller 117 is disposed below the sheet feed roller 113 so as to face the sheet feed roller 113. The retard roller 117 is rotatably supported by the guide wall portion 100 of the main-body housing 10, wherein the guide wall portion 100 is described below. The retard roller 117 and the sheet feed roller 113 form a sheet feed nip portion therebetween through which the sheet S passes. The main conveyance path 22F is extended from the sheet storage portion 110S of the sheet feed cassette 110 in such a way as to pass through the sheet feed nip portion. The retard roller 117 is configured to rotate by following the rotation of the sheet feed roller 113. If a plurality of sheets S enter the sheet feed nip portion, only the uppermost sheet S is conveyed toward the downstream in the sheet conveyance direction by the sheet feed roller 113. The other sheets S abut on the circumferential surface of the retard roller 117 and stay at the sheet feed nip portion. Here, the retard roller 117 stops rotating.

As shown in FIG. 1 and FIG. 3, the guide wall portion 100 is a part of the main-body housing 10. The guide wall portion 100 is a unit that is disposed in the main-body housing to face the sheet feed cassette 110, and guides the sheet S 10. The guide wall portion 100 includes a sheet guide surface 100A (guide surface). The sheet guide surface 100A is a guide surface that is curved and disposed on the upper surface of the guide wall portion 100. The sheet guide surface 100A defines a part of the main conveyance path 22F and guides the sheet S fed from the sheet feed cassette 110 toward the registration roller pair 23 (see FIG. 1).

Furthermore, the guide wall portion 100 includes a central housing 100A1 and positioning portions 100B (the insertion holes). The central housing 100A1 is a housing that can be attached to and detached from the central portion of the guide wall portion 100 in the sheet width direction. As shown in FIG. 4, the central housing 100A1 includes a guide portion 100A2, an opening portion 100H, a left plate 100A3, a right plate 100A4, a pair of lock mechanisms 50, and a holder 60.

The guide portion 100A2 forms an upper surface portion of the central housing 100A1 at the central portion of the central housing 100A1 in the sheet width direction. In addition, the guide portion 100A2 includes a guide surface that forms a part of the sheet guide surface 100A (see FIG. 3). The opening portion 100H is an opening formed in a part of the guide portion 100A2, the part being on the upstream side in the sheet conveyance direction. In the opening portion 100H, the holder 60 is pivotably stored.

The left plate 100A3 is a plate part disposed in the left of the guide portion 100A2, and stands upright with a rectangular shape that extends in the up-down and left-right directions. Similarly, the right plate 100A4 is a plate part disposed in the right of the guide portion 100A2, and stands upright with the rectangular shape. It is noted that in the present embodiment, the guide portion 100A2, the left plate 100A3, and the right plate 100A4 are integrally molded from a resin material.

The pair of lock mechanisms 50 are respectively supported by the left plate 100A3 and the right plate 100A4 of the central housing 100A1. As shown in FIG. 3 and FIG. 4, the lock mechanisms 50 are disposed in the main-body housing 10 to face the cassette rear wall 110C of the sheet feed cassette 110. The lock mechanisms 50 have a function to lock the sheet feed cassette 110 attached to the main-body housing 10 and position the sheet feed cassette 110 in the sheet conveyance direction.

As shown in FIG. 4 and FIG. 5, the lock mechanisms 50 respectively include lock fulcrum portions 51 (the fulcrum portions), lock engaging portions 52 (the lock pieces), lock supporting portions 53, and biasing springs 70 (the spring members). The lock fulcrum portions 51 are fulcrums that are pivotably supported by the left plate 100A3 and the right plate 100A4 of the central housing 100A1, respectively. The lock engaging portions 52 are projection pieces projecting respectively from the lock fulcrum portions 51 toward the cassette rear wall 110C of the sheet feed cassette 110 (see FIG. 5). The lock engaging portions 52 are disposed to be slightly above the projection portions 110C1 of the sheet feed cassette 110. Tip portions of the lock engaging portions 52 (end portions on the upstream side in the sheet feed cassette 110 attachment direction) have an inverted triangular shape, as shown in FIG. 5.

Specifically, the lock engaging portions 52 respectively include second abutting surfaces 52A and second engaging surfaces 52B. The second abutting surfaces 52A are each, among a pair of inclined surfaces forming a mountain shape of the lock engaging portion 52, an inclined surface disposed on the front side in the sheet feed cassette 110 attachment direction. As shown in FIG. 5, the second engaging surfaces 52B are inclined upward toward the front along the attachment direction. On the other hand, the second abutting surfaces 52A are inclined surfaces of the lock engaging portions 52 and are connected with the rear ends of the second engaging surfaces 52B in the attachment direction. The second abutting surfaces 52A are inclined downward toward the front along the attachment direction. The lock supporting portions 53 are projections projecting from the upper surface portions of the lock engaging portions 52, and the lower end portions of the biasing springs 70 are fixed to the lock supporting portions 53.

The biasing springs 70 are springs disposed in a compressed state between the lock supporting portions 53 of the pair of lock mechanisms 50 and housing supporting portions 100C (see FIG. 5) that are disposed on both sides of the central housing 100A1 of the guide wall portion 100. The biasing springs 70 are respectively disposed in the pair of lock mechanisms 50. In addition, the biasing springs 70 bias the lock engaging portions 52 downward. It is noted that in the state shown in FIG. 5, a restriction portion (not shown) provided in the lock mechanism 50 is abutting on the left plate 100A3 or the right plate 100A4. As a result, the lock mechanisms 50 are restricted from pivoting around the lock fulcrum portion 51 such that the lock engaging portions 52 move further downward from the state shown in FIG. 5. On the other hand, the lock mechanisms 50 can pivot around the lock fulcrum portion 51 and the lock engaging portions 52 can move upward from the state shown in FIG. 5. In this case, the biasing springs 70 are further compressed and deformed.

The positioning portions 100B (see FIG. 3) are a pair of cylindrical members disposed outside the pair of lock mechanisms 50 in the sheet width direction. The positioning portions 100B respectively include hole portions that are opened in the front-rear direction. The positioning pins 110F of the sheet feed cassette 110 are configured to be inserted in the hole portions of the positioning portions 100B. As a result, the positioning portions 100B position the sheet feed cassette 110 with respect to the main-body housing 10.

The holder 60 is pivotably stored in the opening portion 100H of the central housing 100A1. The holder 60 includes a pair of holder fulcrum portions 61. The holder fulcrum portions 61 are pivotally supported by the guide portion 100A2 on the upstream side in the sheet conveyance direction. The holder fulcrum portions 61 become the fulcrum portion in the pivoting of the holder 60. As shown in FIG. 4, the holder 60 rotatably supports the retard roller 117, and is pivotably supported by the central housing 100A1. In other words, the retard roller 117 is supported by the central housing 100A1 via the holder 60. The holder 60 is biased by a biasing coil spring 117S shown in FIG. 4 so as to pivot around the holder fulcrum portions 61 such that the retard roller 117 abuts on the sheet feed roller 113. In the state where the retard roller 117 is abutting on the sheet feed roller 113, the sheet S is fed from the sheet feed cassette 110 (sheet feed operation). On the other hand, when the sheet feed operation ends and the sheet feed cassette 110 is pulled out from the main-body housing 10, the holder 60 is pivoted downward around the holder fulcrum portions 61 by a movement mechanism (not shown). As a result, the retard roller 117 is separated downward from the sheet feed roller 113. That is, with the pivoting of the holder 60, the retard roller 117 can contact or separate from the sheet feed roller 113. As a result, when the sheet feed cassette 110 is pulled out, the sheet S nipped in the sheet feed nip portion is prevented from remaining in the main-body housing 10.

It is noted that as shown in FIG. 4, in the central housing 100A1, the lock mechanisms 50 are disposed on one end side and on the other end side of the retard roller 117 which is supported by the holder 60, in the sheet width direction (the left-right direction). That is, the lock mechanisms 50 are respectively disposed on both sides of the retard roller 117 in the sheet width direction.

As shown in FIG. 3 and FIG. 5, when the sheet feed cassette 110 is attached to the main-body housing 10, the positioning pins 110F of the sheet feed cassette 110 are inserted into the positioning portions 100B of the guide wall portion 100. At this time, the first abutting surfaces 110C3 of the projection portions 110C1 push up the second abutting surfaces 52A of the lock mechanisms 50, and the lock engaging portions 52 are pivoted upward around the lock fulcrum portion 51 against the biasing force of the biasing springs 70. Subsequently, the first abutting surfaces 110C3 pass the second abutting surfaces 52A, and the second engaging surfaces 52B closely contact the first engaging surfaces 110C4 by the biasing force of the biasing springs 70, thereby the projection portions 110C1 are engaged with the lock engaging portions 52 of the lock mechanisms 50. In this way, when the sheet feed cassette 110 is inserted into the main-body housing 10, the pair of projection portions 110C1 are engaged with the pair of lock engaging portions 52, thereby the sheet feed cassette 110 is locked to the inside of the main-body housing 10. That is, it is possible to lock the sheet feed cassette 110 to the inside of the main-body housing 10 in response to the attachment operation of the sheet feed cassette 110. In particular, a smooth engagement of the projection portions 110C1 and the lock engaging portions 52 is realized by the first abutting surfaces 110C3 and the first engaging surfaces 110C4 of the projection portions 110C1 and the second abutting surfaces 52A and the second engaging surfaces 52B of the lock engaging portions 52.

Meanwhile, conventionally, a lock mechanism is disposed only on one end side in the sheet width direction, on the front side of the sheet feed cassette 110. As a result, the sheet feed cassette 110 may be attached obliquely to the main-body housing 10 and an inclined conveyance of a sheet S may occur.

In the present embodiment, as described above, the pair of lock mechanisms 50 are disposed in the main-body housing 10 to face the cassette rear wall 110C of the main-body housing 10. In addition, the lock mechanisms 50 are disposed on one end side and on the other end side of the retard roller 117 in the sheet width direction. As a result, lock positions at which the sheet feed cassette 110 is locked to the main-body housing 10 are formed in such a way as to sandwich the retard roller 117 in the sheet width direction. Accordingly the configuration prevents the sheet feed cassette 110 from being attached to the main-body housing 10 in a state where the sheet feed cassette 110 is inclined with respect to the main-body housing 10, more specifically, in a state where the cassette rear wall 110C of the sheet feed cassette 110 is inclined with respect to the axis direction of the rotation of the retard roller 117. As a result, the configuration restricts an inclined conveyance of a sheet S fed from the sheet feed cassette 110.

Furthermore, in the present embodiment, the lock mechanisms 50 are supported by the central housing 100A1 that supports the retard roller 117. As a result, it is restricted that many parts intervene between the lock mechanisms 50 and the retard roller 117, and the positional relationship between the lock mechanisms 50 and the retard roller 117 is maintained with high accuracy. As a result, the positional precision of the sheet feed cassette 110 with respect to the retard roller 117 is improved, and a sheet S is conveyed in a stable manner.

Furthermore, in the present embodiment, the central housing 100A1 by which the lock mechanisms 50 are supported includes the guide portion 100A2. As a result, it is restricted that many parts intervene between the lock mechanisms 50 and the main conveyance path 22F. As a result, the positional precision of the sheet feed cassette 110 with respect to the main conveyance path 22F is improved, and a sheet S is conveyed in a stable manner.

In addition, in the present embodiment, the lock mechanisms 50 and the positioning portions 100B are disposed adjacent to each other. As a result, the positioning and locking of the sheet feed cassette 110 to the main-body housing 10 are realized in the peripheral of the retard roller 117 in a concentrated manner. This makes it possible to convey a sheet S in a stable manner from the sheet feed cassette 110 to the main conveyance path 22F.

Furthermore, the central housing 100A1 constitutes a part of the guide wall portion 100 and can be attached to and detached from the guide wall portion 100. As a result, the maintenance of the retard roller 117 and the lock mechanisms 50 becomes easy. In addition, it becomes possible to adjust positions of the retard roller 117 and the lock mechanisms 50.

Up to now, the sheet feed portion 20 according to an embodiment of the present disclosure and the image forming apparatus 1 including the same have been described. According to the image forming apparatus 1 of the present embodiment, an inclined conveyance of a sheet S is restricted, and an image is formed on the sheet S in a stable manner. It is noted that the present disclosure is not limited to such a configuration, but may have, for example, the following modified embodiment.

In the above-described embodiment, the lock mechanisms 50 are disposed inside the positioning portions 100B in the sheet width direction. However, the present disclosure is not limited to the configuration. The lock mechanisms 50 may be disposed outside the positioning portions 100B in the sheet width direction.

In the above-described embodiment, in the guide wall portion 100, the positioning portions 100B are disposed outside the central housing 100A1 in the sheet width direction. However, the present disclosure is not limited to the configuration. As applied to the lock mechanisms 50, the positioning portions 100B may be included in the central housing 100A1. It is noted that with a configuration where, in the guide wall portion 100, the positioning portions 100B are disposed outside the central housing 100A1 in the sheet width direction, positioning of the sheet feed cassette 110 with respect to the main-body housing 10 can be made in a stable manner even when the attachment position of the central housing 100A1 varies with respect to the guide wall portion 100. In other words, without reducing the positional precision of the sheet feed cassette 110 with respect to the main-body housing 10, the holder 60 that supports the retard roller 117 in a rotatable and movable manner, can be attached to and detached from the guide wall portion 100.

In the above-described embodiment, the central housing 100A1 as the support unit is attachable to and detachable from the guide wall portion 100. However, the present disclosure is not limited to the configuration. The guide wall portion 100 itself may function as the support unit of the present disclosure.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. A sheet feed device comprising:

a device main body;

a sheet feed cassette inserted and attached to the device main body in a predetermined attachment direction and including a sheet storage portion and a wall portion, the sheet storage portion storing a sheet, the wall portion standing upright at a position more on a front side in the attachment direction than the sheet storage portion;

a sheet conveyance path provided in the device main body and configured to guide the sheet stored in the sheet storage portion into the device main body from an entrance formed more on the front side in the attachment direction than the wall portion;

a sheet feed roller disposed at a central portion of the device main body in a sheet width direction crossing the attachment direction, on a side of the entrance of the sheet conveyance path and configured to feed the sheet into the sheet conveyance path;

a retard roller disposed to face the sheet feed roller in the device main body and, together with the sheet feed roller, forming a sheet feed nip portion through which the sheet is passed;

a support unit disposed in the device main body and supporting the retard roller; and a pair of lock mechanisms supported by the support unit so as to face the wall portion of the sheet feed cassette, the lock mechanisms respectively disposed on both sides of the retard roller in the sheet width direction and configured to lock the sheet feed cassette attached to the device main body and position the sheet feed cassette in the attachment direction, wherein the pair of lock mechanisms respectively include:

fulcrum portions pivotably supported by the support unit;

lock pieces projecting from the fulcrum portions toward the wall portion of the sheet feed cassette; and spring members disposed in a compressed state between the lock pieces and the support unit, the sheet feed cassette includes a pair of projection portions that project from the wall portion in the attachment direction, when the sheet feed cassette is attached to the device main body, the pair of projection portions are engaged with the pair of lock pieces, thereby the sheet feed cassette is locked, the projection portions respectively include:

first abutting surfaces inclined downward toward a front along the attachment direction; and first engaging surfaces connected respectively with rear end sides of the first abutting surfaces in the attachment direction, and inclined upward toward the front along the attachment direction, the lock pieces are disposed above the projection portions and respectively include:

second engaging surfaces inclined upward toward the front along the attachment direction; and second abutting surfaces connected with rear end sides of the second engaging surfaces in the attachment direction, and inclined downward toward the front along the attachment direction, and when the sheet feed cassette is attached to the device main body, the first abutting surfaces respectively abut on the second abutting surfaces and push up the lock pieces, and the lock pieces are pivoted upward around the fulcrum portion against a biasing force of the spring members, thereby the first abutting surfaces pass the second abutting surfaces, and then the lock pieces are pivoted downward by the biasing force of the spring members, thereby the second engaging surfaces closely contact the first engaging surfaces, thereby the projection portions are engaged with the lock pieces.

2. The sheet feed device according to claim 1 further comprising:

a holder rotatably supporting the retard roller, wherein the holder is pivotably supported by the support unit.

3. The sheet feed device according to claim 1, wherein the device main body includes a guide unit that is disposed to face the sheet feed cassette and includes a sheet guide surface that guides the sheet, and the support unit constitutes a part of the guide unit and is attachable to and detachable from the guide unit.

4. The sheet feed device according to claim 3, wherein the support unit defines a part of the sheet guide surface.

5. The sheet feed device according to claim 1 further comprising:

a guide unit disposed in the device main body to face the sheet feed cassette and including a sheet guide surface that guides the sheet;

a pair of positioning pins projecting in the attachment direction from the wall portion and disposed at positions sandwiching the pair of projection portions in the sheet width direction; and a pair of insertion holes provided in the guide unit in such a manner that the positioning pins are respectively inserted in the insertion holes so as to position the sheet feed cassette with respect to the guide unit.

6. An image forming apparatus comprising:

the sheet feed device according to claim 1; and an image forming portion configured to form an image on the sheet conveyed by the sheet feed roller.

* * * * *